United States Patent [19]

Miyamoto et al.

[11] Patent Number: 4,838,957

[45] Date of Patent: Jun. 13, 1989

[54] PHOSPHATE COATINGS FOR METAL SURFACES

[75] Inventors: Satoshi Miyamoto; Masamichi Nagatani, both of Neyagawashi, Japan

[73] Assignee: Amchem Products, Inc., Ambler, Pa.

[21] Appl. No.: 159,474

[22] Filed: Feb. 16, 1988

Related U.S. Application Data

[63] Continuation of Ser. No. 770,031, Aug. 27, 1985, abandoned, which is a continuation-in-part of Ser. No. 526,177, Aug. 24, 1983, abandoned.

[30] Foreign Application Priority Data

Aug. 24, 1982 [JP] Japan ..... 57-147226

[51] Int. Cl.[4] ..... C23C 22/12; C23C 22/18

[52] U.S. Cl. ..... 148/260; 148/262

[58] Field of Search ..... 148/6.15 Z

[56] References Cited

U.S. PATENT DOCUMENTS

| | | | |
|---|---|---|---|
| 4,292,096 | 9/1981 | Murakami et al. | 148/6.15 |
| 4,311,535 | 1/1982 | Yasuhara et al. | 148/6.15 |
| 4,338,141 | 7/1982 | Senzaki et al. | 148/6.15 |
| 4,595,424 | 6/1986 | Hacias | 148/6.15 Z |

FOREIGN PATENT DOCUMENTS 57-152472 4/1982 Japan .

*Primary Examiner*—Sam Silverberg

*Attorney, Agent, or Firm*—Ernest G. Szoke; Wayne C. Jaeschke; Norvell E. Wisdom, Jr.

[57] ABSTRACT

Processes and solutions for phosphating metal surfaces. The solutions are acidic aqueous phosphate solutions containing (a) from 0.1 to 1.5 g/l of zinc ion; (b) from 5 to 50 g/l of phosphate ion; (c) from 0.2 to 4 g/l of manganese ion; (d) at least 0.05 g/l of fluoride ion; (e) less than 0.5 g/l of chloride ion; and (f) a phosphating accelerator. The metal surface phosphated with the solution including galvanized steel, is free of white spots and is suitable for electrocoating.

25 Claims, No Drawings

PHOSPHATE COATINGS FOR METAL SURFACES

This application is a continuation of application Ser. No. 770,031, filed Aug. 27, 1985, now abandoned, which is a continuation-in-part of Ser. No. 526,177, filed Aug. 24, 1983, now abandoned.

BACKGROUND OF THE INVENTION

1. Field of the Invention

The present invention relates to an acidic aqueous phosphate solution and a process for phosphating a metal surface with said solution. More particularly, it relates to a solution and a process for forming a phosphate film especially suitable for cationic electrocoating, and is particularly applicable to metal surfaces which include an iron-based surface and a zinc-based surface such as an automobile body.

2. Description of Related Art

Japanese Patent Publication (unexamined) No. 107784/1980 (laid-open to the public on Aug. 19, 1980) discloses a process for treating a metal surface by dip treatment, followed by spray treatment, with an acidic aqueous phosphate solution containing from 0.5 to 1.5 g/l of zinc ion, from 5 to 30 g/l of phosphate ion, and from 0.01 to 0.2 g/l of nitrite ion and/or from 0.05 to 2 g/l of m-nitrobenzenesulfonate ion. Said process is reported to be capable of providing a phosphate film which is effective for forming a coating by cationic electrocoating having excellent adhesion and corrosion-resistance on complicated articles having many pocket portions like car bodies.

Japanese Patent Publication (unexamined) No. 145180/1980 (laid-open to the public on Nov. 12, 1980) discloses a process for treating a metal surface by spray treatment with an acidic aqueous phosphate solution containing from 0.4 to 1.0 g/l of zinc ion, from 5 to 40 g/l of phosphate ion, from 2.0 to 5.0 g/l of chlorate ion, and from 0.01 to 0.2 g/l of nitrite ion. Further, Japanese Patent Publication (unexamined) No. 152183/1980 (laid-open to the public on November 27, 1980) discloses an acidic aqueous phosphate solution containing from 0.08 to 0.20 wt. % of zinc ion, from 0.8 to 3.0 wt. % of phosphate ion, from 0.05 to 0.35 wt. % of chlorate ion, from 0.001 to 0.10 wt. % of nitrite ion, and complex fluoride ion in an amount calculated by the formula: $0.4 \geqq y \geqq 0.63x - 0.042$, wherein x is the concentration in wt. % of zinc ion and y is the concentration in wt. % of the complex fluoride ion. These prior art processes are reported to be capable of providing excellent adhesion and corrosionresistance to the coating by cationic electrocoating.

However, in a recent development in the automobile industry there has come to be used for car bodies steel components plated on one surface only with zinc or alloyed zinc, with the object of further improving corrosion-resistance after the application of the siccative coating. It has however come to be recognized that, when the above prior art compositions and processes are applied to such materials (i.e. to metal surfaces which include both an iron-based surface and a zinc-based surface), on the iron-based surface a phosphate film suitable as a substrate to be coated by cationic electrocoating can be formed as desired, but a phosphate film formed on a zinc-based surface is significantly inferior to that formed on the iron-based surface.

There has been developed a composition and process to solve the above-mentioned problems which occur on zinc-based surfaces in components which include both an iron-based surface and a zinc-based surface. This is the invention disclosed in Japanese Patent Publication (unexamined) No. 152472/1982 (laid-open to the public on Sep. 20, 1982). Said invention is characterized by subjecting the metal surface to treatment with an acidic aqueous phosphate solution comprising from 0.5 to 1.5 g/l of zinc ion, from 5 to 30 g/l of phosphate ion, from 0.6 to 3 g/l of manganese ion, and a phosphating accelerator.

However, in the zinc phosphate treatment of galvanized steel, there often results an abnormal coating with white spots, each spot having a diameter of from 1 mm to 2 mm. This is particularly true with an electroplated galvanized steel and especially in the dip treatment thereof. These white spots will cause craters in subsequent treatment, thereby resulting in inferior coatings. The mechanism by which white spots are formed is believed to be as follows: In a first stage, there appear many pits, at the edge portions of which the galvanized layer is gradually dissolved in the form of concentric circles through an excessive etching reaction. As the growth of each pit continues, zinc phospate is precipitated in the center portion thereof, However, at the peripheral portions, the iron surface is exposed, which forms a galvanic cell with the zinc metal, thereby continuing the dissolution of the zinc.

As a consequence, an excess quantity of zinc phosphate crystals are precipitated and accumulate as "snow" at the peripheral portions of the spots, which can readily be observed by the naked eye.

Unfortunately, no solution to this problem has been found heretofor to consistently avoid the formation of such white spots.

DESCRIPTION OF THE INVENTION

The present invention represents a further improvement in the above techniques for phosphating as a substrate treatment under cationic electrocoating.

Accordingly, an object of the present invention is to provide an acidic aqueous phosphate solution which can give a phosphate film capable of providing excellent adhesion and corrosion-resistance to coatings from cationic electrocoating.

Another object of the present invention is to provide an acidic aqueous phosphate solution which provides excellent phosphate films on metal surfaces which include an iron-based surface, a zinc-based surface, and/or an aluminum-based surface.

Another object of the present invention is to provide an acidic aqueous phosphate solution which will not cause any white spots or at least any significant white spots on galvanized steel even in the dip treatment thereof.

Another object of the present invention is to provide an acidic aqueous phosphate solution which can give said phosphate film by treatment at low temperature.

A further object of the present invention is to provide a process for forming a phosphate film with said acidic aqueous phosphate solution.

A further object of the present invention is to provide a process by which a phosphate film can be satisfactorily formed on an article having a complicated shape like a car body.

A further object of the present invention is to provide an aqueous concentrated composition for formulating said acidic aqueous phosphate solution.

Other objects and advantages of the present invention will become apparent from the following disclosure.

It has now been found that phosphating compositions which are chlorate-free or at least substantially chlorate-free and which have a chloride ion level below 0.5 g/l provide excellent phosphate-coatings on iron, zinc, and aluminum-based surfaces, without the formation of deleterious white spots. It is important to the beneficial results of the present invention that the chloride ion level be consistently maintained below 0.5 g/l, which means that not only the chloride ion itself, but also the chlorate ion should not be added to the phosphating compositions, since the chlorate ion will be reduced to the chloride ion as the phosphating composition is used.

As stated above, the metal surfaces treated in accordance with the present invention include iron-based surfaces, zinc-based surfaces, aluminum-based surfaces, and their respective alloy-based surfaces. These metal surfaces can be treated either separately or in combination. The advantage of the present invention is most prominently exhibited when the treatment is carried out on metal surfaces which include both an iron-based surface and a zinc-based surface, as, for example, in a car body. Examples of zinc-based surfaces include galvanized steel plate, galvanealed steel plate, electrogalvanized steel plate, electro zinc-alloy plated steel plate, complex electrogalvanized steel plate, electro zinc-alloy plated steel plate, complex electrogalvanized steel plate, etc. The acidic aqueous phosphate solutions of the invention contain:

(a) from about 0.1 to about 1.5 g/l, preferably from about 0.5 to about 1.4 g/l of zinc ion;

(b) from about 5 to about 50 g/l, preferably from about 10 to about 30 g/l, of phospate ion;

(c) from about 0.2 to about 4 g/l, preferably from about 0.6 to about 3 g/l, of manganese ion;

(d) at least about 0.05 g/l, preferably from about 0.1 to about 3 g/l, of a fluoride ion;

(e) less than 0.5 g/l of chloride ion, and (f) a phosphating accelerator (conversion coating accelerator) which is one or more of the following:

(i) from about 0.01 to about 0.2 g/l, preferably from about 0.04 to about 0.15 g/l, of nitrite ion;

(ii) from about 1 to about 10 g/l, preferably from about 2 to about 8 g/l, of nitrate ion;

(iii) from about 0.5 to about 5 g/l, preferably from about 1 to about 1.5 g/l of hydrogen peroxide (based on 100 % $H_2O_2$);

(iv) from about 0.05 to about 2 g/l, preferably from about 0.1 to about 1.5 g/l, of m-nitrobenzenesulfonate ion;

(v) from about 0.05 to about 2 g/l, preferably from about 0.1 to about 1.5 g/l, of m-nitrobenzoate ion; and (vi) from about 0.05 to about 2 g/l, preferably from about 0.1 to about 1.5 g/l, of p-nitrophenol.

When the content of the zinc ion in the above acidic phosphate solution is less than about 0.1 g/l, an even phosphate film is not formed on the iron-based surfaces. When the zinc ion content exceeds about 1.5 g/l, then on both iron-based and zinc-based surfaces continuing formation of the phosphate film occurs, causing a build-up of said film, with the result that the film shows a decrease in adhesion and becomes unsuitable as a substrate for cationic electrocoating.

When the content of phosphate ion in the above solution is less than about 5 g/l, an uneven phosphate film is apt to be formed. When the phosphate ion content is more than 50 g/l, no further benefits result, and it is therefore economically disadvantageous to use additional quantities of phosphate chemicals.

When the content of manganese ion is less than 0.2 g/l the manganese content in the phosphate film formed on zinc-based surfaces is very small; therefore the adhesion between the substrate and the coating after the cationic electrocoating becomes insufficient. When the manganese ion is present in an amount of more than 4 g/l, no further beneficial effects are obtained for the coating, and the solution forms excessive precipitates, making it impossible to obtain a stable solution.

It is essential that the manganese content in the phosphate film formed on the metal substrates be in the range of from about 1 to about 20% by weight, based on the weight of the film, in order to have a phosphate film which exhibits the performance requirements for cationic electrocoating. The phosphate film containing the amount of manganese specified above also forms part of the present invention.

The content of manganese in the phosphate film can be determined according to conventional procedures. For example, a phosphated test piece [$S(m^2)$; $W_1(g)$] is dipped in an aqueous solution of 5 % by weight of chromic acid at 75° C. for 5 minutes to dissolve the film, and the weight of the test piece after treatment [$W_2(g)$] is measured. The amount of film [$W_c(g/m^2)$] is obtained by calculating the formula: [$W_c=(W_1-W_2)/S$]. Then, the amount of manganese which dissolved into said aqueous solution of chromic acid [A(l)] is determined by the atomic light absorption process [M(g/l)] to obtain the total amount of the dissolved manganese [$W_M=AxM/s(g/M^2)$]. Using the thus obtained amount and the above film amount, the manganese content can be calculated from the formula ($W_M/W_C$) x 100%.

When the amount of fluoride ion in the phosphating solution is less than 0.05 g/l, micronization of the phosphate film, improvement of corrosion-resistance after coating, and phosphating treatment at a reduced temperature cannot be attained. The fluoride ion can be present in an amount above 3 g/l, but use thereof in such quantities will not provide any greater effects than are obtainable by the phosphating solutions of the invention. Preferably, the fluoride ion is contained in the form of a complex fluoride ion, e.g. the fluoroborate ion or the fluorosilicate ion, although the $F^-$ ion itself can also be used.

It has been found that when the chloride ion concentration in the phosphating solution reaches or exceeds 0.5 g/l (500 ppm), there occurs an excessive etching reaction which results in undesirable white spots on zinc surfaces. Though the presence of chlorate ions themselves may not directly cause the development of white spots, they are gradually changed to chloride ions and accumulate in that form in the bath liquid thereby causing white spots as mentioned hereinabove.

Furthermore, the combination of manganese and fluoride ions has been found to be effective for the formulation of useful phosphating solutions containing no chlorate ions.

In the phosphating solutions of the invention it is preferably that the weight ratio of zinc ion to phosphate ion be 1 : (10 to 30). In this ratio an even phosphate film is obtained which exhibits all of the performance requirements needed for cationic electrocoating. The weight ratio of zinc ion to manganese ion is preferably 1 : (0.5 to 2). In this ratio it is possible to obtain in an economic manner a phosphate film which contains the required amount of manganese and which displays all of the beneficial effects provided by the present invention.

In the phosphating solutions of the invention, it is desirable for the solutions to have a total acidity of 10 to 50 points, a free acidity of 0.3 to 2.0 points, and an acid ratio of 10 to 50. With the total acidity in the above range, the phosphate film can be obtained economically, and with the free acidity in the above range, the phosphate film can be obtained evenly without excessive etching of the metal surface. Adjustments in the solution to obtain and maintain the above points and ratio can be achieved by use of an alkali metal hydroxide or ammonium hydroxide as required.

Sources of the ingredients of the phosphating solutions of the invention include the following: as to the zinc ion; zinc oxide, zinc carbonate, zinc nitrate, etc.; as to the phosphate ion, phosphoric acid, zinc phosphate, zinc monohydrogen phosphate, zinc dihydrogen phosphate, manganese phosphate, manganese monohydrogen phosphate, manganese dihydrogen phosphate, etc.; as to the manganese ion; manganese carbonate, manganese nitrate, the above manganese phosphate compounds, etc.; as to the fluoride ion, hydrofluoric acid, fluoroboric acid, fluorosilicic acid, fluorotitanic acid, and their metal salts (e.g., zinc salt, nickel salt, etc.; however, the sodium salt is excluded as it does not produce the desired effect); and as to the phosphating acccelerator, sodium nitrite, ammonium nitrite, sodium m-nitrobenzenesulfonate, sodium m-nitrobenzoate, aqueous hydrogen peroxide, nitric acid, sodium nitrate, zinc nitrate, manganese nitrate, nickel nitrate, etc.

The phosphating solutions of the invention can further contain, as an optional ingredient, nickel ion. The content of the nickel ion should be from about 0.1 to about 4 g/l, preferably about 0.3 to about 2 g/l. When nickel ion is present with the manganese ion, performance of the resulting phosphate film is further improved, i.e., the adhesion and corrosion-resistance of the coating obtained after cationic electrocoating are further improved. In phosphating solutions containing nickel ion, the weight ratio of zinc ion to the sum of the manganese ion and the nickel ion is desirably 1 : (0.5 to 5.0), preferably 1 : (0.8 to 2.5). The supply source of nickel ion can be, for example, nickel carbonate, nickel nitrate, nickel phosphate, etc.

The phosphate film formed by the solutions of the present invention is a zinc phosphate-type film. Such films formed on iron-based metal surfaces contain from about 25 to about 40 wt. % of zinc, from about 3 to about 11 wt. % of iron, from about 1 to about 20 wt. % of manganese, and from 0 to about 4 wt. % of nickel.

The process of the present invention for phosphating metal surfaces by use of the phosphating solutions of the invention can be carried out by spray treatment, dip treatment, or by a combination of such treatments. Spray treatment can usually be effected by spraying 5 or more seconds in order to form an adequate phosphate film which exhibits the desired performance characteristics. As to this spray treatment, a treatment can be carried out using a cycle comprising first a spray treatment for about 5 to about 30 seconds, followed by discontinuing the treatment for about 5 to 30 seconds and then spray treating again for at least 5 seconds with a total spray treatment time of at least 40 seconds. This cycle can be carried out once, twice, or three times.

Dip treatment is an embodiment which is more preferable than spray treatment in the process of the present invention. In order to form an adequate phosphate film which exhibits the desired performance characteristics, the dip treatment is usually effected for at least 15 seconds, preferably for about 30 to about 120 seconds. Also, treatment can be carried out by first dip treating for at least 15 seconds and then spray treating for at least 2 seconds. Alternatively, the treatment can be effected by first spray treating for at least 5 seconds, and then dip treating for at least 15 seconds. The former combination of first dip treating and then spray treating is especially advantageous for articles having complicated shapes like a car body. For such articles, it is preferable to first carry out a dip treatment for from about 30 to about 90 seconds, and then carry out the spray treatment for from about 5 to about 45 seconds. In this process, it is advantageous to effect the spray treatment for as long a time as is possible within the limitations of the automotive production line, in order to remove the sludge which adheres t the article during the dip treatment stage.

In the present process, the treating temperature can be from about 30° to about 70° C., preferably from about 35° to about 60° C. This temperature range is approximately 10° to 15° C. lower than that which is used in the prior art processes. Treating temperatures below 30° C. should not be used due to an unacceptable increase in the time required to produce an acceptable coating. Conversely, when the treating temperature is too high, the phosphating accelerator is decomposed and excess precipitate is formed causing the components in the solution to become unbalanced and making it difficult to obtain satisfactory phosphate films.

In spray treatments, a convenient spray pressure is from 0.6 to 2 $Kg/cm^2G$.

As described above, a preferred mode of treatment in the process of the present invention is a dip treatment or a combined treatment using a dip treatment first and then a spray treatment.

An advantageous procedure for treating metal surfaces using a series of pre-coating treatment processes followed by phosphating in accordance with the process of the present invention is as follows:

A metal surface is first subjected to a spray treatment and/or a dip treatment with an alkaline degreasing agent at a temperature of 50° to 60° C. for 2 minutes; followed by washing with tap water; spray treatment and/or dip treatment with a surface conditioner at room temperature for 10 to 30 seconds; dip treatment with the solution of the present invention at a temperature of about 30° to about 70° C. for at least 15 seconds; and washing with tap water and then with deionized water, in that order. Thereafter, it is desirable to after-treat with an acidulated rinse common to the industry such as a dilute chromate solution. This after-treatment is preferably adopted even when the present invention is carried out by spray treatment, or by a combined treatment comprising a spray treatment, followed by a dip treatment. By introducing this after-treatment, a phosphate film which gives greater corrosion-resistance to a siccative coating can be obtained.

When carrying out the dip treatment or the dip treatment followed by spray treatment, which is the preferred treating method of the present invention, it is advantageous to use an acidic aqueous phosphate solution of the present invention comprising:

(a') from about 0.5 to about 1.5 g/l, preferably from about 0.7 to about 1.2 g/l, of zinc ion, (b') from about 5 to about 30 g/l, preferably from about 10 to about 20 g/l, of phosphate ion, (c') from about 0.6 to about 3 g/l, preferably from about 0.8 to about 2 g/l, of manganese ion, (d') at least about 0.05 g/l, preferably from about 0.1 to about 2 g/l, of a fluoride ion, (e') less than 0.5 g/l of chloride ion, and (f') a phosphating accelerator in a quantity given above (hereinafter referred to as the "dipping solution").

When using the above dipping solution of the invention in the process of the invention on a metal surface, especially a metal surface which includes both an iron-based surface and a zinc-based surface, there is formed thereon in an economic manner a fine, even, and dense phosphate film which provides excellent adhesion and corrosion-resistance to coatings formed by cationic electrocoating, and which is substantially free of white spots.

The present invention further provides a concentrated aqueous composition for formulating the acidic aqueous phosphate solutions of the present invention. The acidic aqueous treating solutions are conveniently prepared by diluting an aqueous concentrate which contains a number of the solution ingredients in proper weight ratios, and then adding other ingredients as needed to prepare the treating solutions of the invention. The concentrates are advantageously formulated to contain zinc ion, phosphate ion, manganese ion, fluoride ion, and optionally, nickel ion, in a weight proportion of 0.1 to 2 : 5 to 50 : 0.2 to 4 : at least 0.05 : 0.1 to 4. The concentrates preferably contain a weight proportion of the above ingredients of 0.5 to 1.5 : 10 to 30 : 0.6 to 3 : 0.1 to 3 : 0.3 to 2. The concentrates are preferably formulated to contain at least about 25 g/l, more preferably from about 50 g/l to 130 g/l of zinc ion. However, care must be taken in forming the concentrates. For example, when manganese ion and complex fluoride ion are present together in a concentrate with sodium ion, a precipitate is formed. Also, it is not advisable to add any phosphating accelerator to the concentrate, since the accelerators tend to decompose and cause other problems.

As an example of a useful concentrated aqueous composition, there is formulated a concentrated composition comprising 3.0 wt. % of zinc oxide, 1.8 wt. % of nickel carbonate (II), 48.2 wt. % of 75 % phosphoric acid, 10.0 wt. % of manganese nitrate (II) hydrate (20 wt. % manganese content), 7.9 wt. % of 40 % fluorosilicic acid, and 29.1 wt. % of water. This concentrate is then diluted with water to 2.5 vol. %, followed by the addition of an aqueous solution of 20 % sodium nitrite to give an acidic phosphating solution of the invention.

Practical and preferred embodiments of the present invention are illustratively shown in the following Examples and Comparative Examples. It is to be understood, however, that the present invention is not limited to these examples.

EXAMPLES 1 TO 3 AND COMPARATIVE EXAMPLES 1 TO 3

(1) Metal to be subjected to treatment

Electrogalvanized steel plate (2) Acidic aqueous phosphate solution

The compositions shown in Table 1 were used (3) Treating process:

The surfaces of the above metal were simultaneously treated in accordance with the following processes:

Degreasing, water washing, surface conditioning, phosphating, water washing, pure water washing, drying, coating.

(4) Treating Conditions:

(a) Degreasing:

Using an alkaline degreasing agent ("RIDOLINE SD200" made by Nippon Paint Co., 2 wt. % concentration), spray treatment was carried out at 60° C. for 1 minute, followed by dip treatment for 2 minutes.

(b) Washing with water:

Using tap water, washing was carried out at room temperature for 15 seconds.

(c) Surface conditioning:

Using a surface conditioning agent ("FIXODINE 5N-5" made by Nippon Paint Co., 0.1 wt. % concentration), dip treatment was made at room temperature for 15 seconds.

(d) Phosphating:

Using the above acidic aqueous phosphate solution, dip treatment was carried out at 52° C. for 120 seconds (e) Water washing:

Using tap water, washing was carried out at room temperature for 15 seconds.

(f) Pure water washing:

Using deionized water, dip treatment was effected at room temperature for 15 seconds.

(g) Drying was carried out with hot blown air at 100° C. for 10 minutes.

The appearance of each phosphated plate thus obtained and the weight of the phospate film thereof were determined.

(h) Coating:

A cationic electrocoating composition ("POWER TOP U-30 Dark Grey" made by Nippon Paint Co.) was coated to a film thickness of 20μ(voltage 180 V, electricity applying time 3 minutes), and the surface was baked at 180° C. for 30 minutes. A number of each of the resulting electrocoated plates were used for the brine spray test.

The remaining non-tested electrocoated plates were coated with an intermediate coating composition ("ORGA T0778 Grey" made by Nippon Paint Co.) to a film thickness of 30μ then with a top coating composition ("ORGA T0626 Margaret White" made by Nippon Paint Co.) to a film thickness of 40μ to obtain coated plates having a total of 3-coatings and 3-bakings, which were then used for the adhesion test and the spot rust test.

(5) Test results:

The results are shown in Table 2. Each test method is shown below.

(a) Brine spray test (JIS-Z-2871):

Cross cuts were made on the electrocoated plate, on which 5 % brine spraying was carried out for 500 hours (zinc-plated steel plate) or 1,000 hours (cold rolled steel plate).

(b) Adhesion test:

The coated plate was dipped in deionized water at 50° C. for 10 days, after which it was provided with grids (100 squares each) made at 1 mm intervals and at 2 mm intervals using a sharp cutter. To each surface of the thus treated plate, an adhesive tape was applied, after which it was peeled off and the number of the remaining coated squares on the coated plate was counted.

(c) White spot test:

Presence of white spots was examined by visual observation

O . . . no white spot

X . . . white spots

Additionally, scanning electron microscopic photograph of a white spot of phospate film on electro galvanized steel plate is shown as Reference Photograph:

TABLE 1

| Composition of acidic aqueous phosphate solution | Example 1 | Example 2 | Example 3 | Comparative Example 1 | Comparative Example 2 | Comparative Example 3 |
|---|---|---|---|---|---|---|
| Zn ion (g/l) | 1.0 | 1.0 | 1.0 | 1.0 | 1.0 | 1.0 |
| $PO_4$ ion (g/l) | 14.0 | 14.0 | 14.0 | 14.0 | 14.0 | 14.0 |
| Mn ion (g/l) | 2.0 | 2.0 | 2.0 | 2.0 | 2.0 | 2.0 |
| Ni ion (g/l) | 0.3 | 0.3 | 0.3 | 0.3 | 0.3 | 0.3 |
| $SiF_6$ ion (g/l) (as F ion) | 1.0 | 1.0 | 1.0 | 1.0 | 1.0 | 1.0 |
| $NO_2$ ion (g/l) | 0.06 | 0.06 | 0.06 | 0.06 | 0.06 | 0.06 |
| $NO_3$ ion (g/l) | 4.0 | 4.0 | 4.0 | 4.0 | 4.0 | 4.0 |
| $ClO_3$ ion (g/l) | 0.2 | — | — | 0.2 | — | 2.0 |
| Chloride ion (g/l) | 0.4 | 0.2 | 0.4 | 0.6 | 0.6 | 0.8 |
| Total acidity (Point) | 20.5 | 20.5 | 20.5 | 20.5 | 20.5 | 20.5 |
| Free acidity (Point) | 0.9 | 0.9 | 0.9 | 0.9 | 0.9 | 0.9 |
| Acid ratio | 23 | 23 | 23 | 23 | 23 | 23 |

TABLE 2

| Metal | Test Items | Example 1 | Example 2 | Example 3 | Comparison Example 1 | Comparison Example 2 | Comparison Example 3 |
|---|---|---|---|---|---|---|---|
| Electrogalvanized steel plate | White spot | 0 | 0 | 0 | X | X | X |
| | Film appearance | even, dense excellent | even, dense excellent | even, dense excellent | poor | poor | poor |
| | weight (g/m$^2$) | 2.0 | 2.1 | 2.1 | 2.1 | 2.2 | 1.9 |
| | Brine spraying (mm) | 1.5 | 1.5 | 1.5 | 5.0 | 5.5 | 6.0 |
| | Adhesion 2 mm | 100/100 | 100/100 | 100/100 | 80/100 | 80/100 | 70/100 |
| | 1 mm | 100/100 | 100/100 | 100/100 | 60/100 | 50/100 | 50/100 |

As can be seen from the above Table 2, use of the compositions of the examples of the invention produce commercially highly acceptable phosphate coatings, while those of the comparative examples in which the chloride ion level is over 0.5 g/l produce commercially unsatisfactory coatings. It should be noted that while Example 1 contained a small quantity of chlorate ion (0.2 g/l) which did not deleteriously affect the results obtained using the fresh bath, it is not recommended that the composition of Example 1 be employed commercially since maintaining even this low chlorate level in the bath as the bath continues to be used will eventually result in the reduction of sufficient chlorate ion to elevate the chloride ion level above 0.5 g/l.

We claim:

1. A process for reducing white spots during phosphating a galvanized metal surface comprising treating the galvanized metal surface with an acidic aqueous substantially chlorate-free phosphate solution consisting essentially of:

(a) from about 0.1 to about 1.5 g/l of zinc ion,
(b) from about 5 to about 50 g/l of phosphate ion,
(c) from about 0.2 to about 4 g/l of manganese ion,
(d) at least about 0.05 g/l of a fluoride ion,
(e) less than 0.5 g/l of chloride ion, and
(f) at least one phosphating accelerator of the following:
  (i) from about 0.01 to about 0.2 g/l of nitrite ion,
  (ii) from about 1 to about 10 g/l of nitrate ion,
  (iii) from about 0.5 to about 5 g/l of hydrogen peroxide (based on 100% $H_2O_2$),
  (iv) from about 0.05 to about 2 g/l of m-nitrobenzenesulfonate ion,
  (v) from about 0.05 to about 2 g/l of m-nitrobenzoate ion, and
  (vi) from about 0.05 to about 2 g/l of p-nitrophenol.

2. A process in accordance with claim 1 wherein the fluoride ion in (d) is present as a complex fluoride ion.

3. A process in accordance with claim 2 wherein the complex fluoride ion is the fluoroborate ion or the fluorosilicate ion.

4. A process in accordance with claim 1 wherein at least one of the following quantities of ingredients is present in the acidic aqueous phosphate solution:

(a) from about 0.5 to about 1.4 g/l of zinc ion,
(b) from about 10 to about 30 g/l of phosphate ion,
(c) from about 0.6 to about 3 g/l of manganese ion,
(d) from about 0.1 to about 3 g/l of a fluoride ion.

5. A process in accordance with claim 1 wherein from about 0.1 to about 4 g/l of nickel ion is also present.

6. A process in accordance with claim 1 wherein the weight ratio of zinc ion to phosphate ion is 1 : (10 to 30).

7. A process in accordance with claim 1 wherein the weight ratio of zinc ion to manganese ion is 1: (0.5 to 2).

8. A process in accordance with claim 5 wherein the weight ratio of zinc ion to the sum of manganese ion and nickel ion is 1 : (0.5 to 5).

9. A process in accordance with claim 8 wherein the weight ratio of zinc ion to the sum of manganese ion and nickel ion is 1 : (0.8 to 2.5).

10. A process in accordance with claim 1 which has a total acidity of from 10 to 50 points, a free acidity of from 0.3 to 2.0 points and an acid ratio of from 10 to 50.

11. A process in accordance with claim 1 wherein the treatment is carried out by dip treatment.

12. A process in accordance with claim 11 wherein the dip treatment is carried out for at least 15 seconds.

13. A process in accordance with claim 12 wherein the dip treatment is followed by spray treatment for at least 2 seconds.

14. A process in accordance with claim 1 wherein the treatment is carried out at a temperature in the range of from about 30° to about 70° C.

15. A process in accordance with claim 11 wherein the fluoride ion in (d) is present as a complex fluoride ion.

16. A process in accordance with claim 15 wherein the complex fluoride ion is the fluoroborate ion or the fluorosilicate ion.

17. A process in accordance with claim 11 wherein from about 0.1 to about 4 g/l nickel ion is also present in the solution.

18. A process in accordance with claim 11 wherein at least one of the following quantities of ingredients is present in the acidic phosphate solution:

(a) from about 0.7 to about 1.2 g/l of zinc ion,
(b) from about 10 to about 20 g/l of phosphate ion,
(c) from about 0.8 to about 2 g/l of manganese ion, and
(d) from about 0.1 to about 2 g/l of a fluoride ion.

19. A process in accordance with claim 11 wherein the weight ratio of zinc ion to phosphate ion is 1: (10 t 30).

20. A process in accordance with claim 11 wherein the weight ratio of zinc ion to manganese ion is 1 : (0.5 to 2).

21. A process in accordance with claim 17 wherein the weight ratio of zinc ion to the sum of manganese ion and nickel ion is 1 : (0.5 to 5).

22. A process in accordance with claim 21 wherein the weight ratio of zinc ion to the sum of manganese ion and nickel ion is 1 : (0.8 to 2.5).

23. A process in accordance with claim 11 wherein the treatment is carried out at a temperature of from about 30° to about 70° C.

24. A process in accordance with claim 1 wherein following said process, the metal surface is rinsed and electrocoated.

25. A process in accordance with claim 24 wherein the metal surface is cationic electrocoated.

* * * * *